US008729782B2

(12) United States Patent
Lykowski et al.

(10) Patent No.: US 8,729,782 B2
(45) Date of Patent: May 20, 2014

(54) NON-THERMAL PLASMA IGNITION ARC SUPPRESSION

(75) Inventors: James D. Lykowski, Temperance, MI (US); Keith Hampton, Ann Arbor, MI (US); William J. Walker, Jr., Toledo, OH (US)

(73) Assignee: Federal-Mogul Ignition, Southfield, MI (US)

( * ) Notice: Subject to any disclaimer, the term of this patent is extended or adjusted under 35 U.S.C. 154(b) by 191 days.

(21) Appl. No.: 13/283,666

(22) Filed: Oct. 28, 2011

(65) Prior Publication Data

US 2012/0112620 A1 May 10, 2012

Related U.S. Application Data

(60) Provisional application No. 61/407,633, filed on Oct. 28, 2010, provisional application No. 61/407,643, filed on Oct. 28, 2010.

(51) Int. Cl.

| | |
|---|---|
| ***H01T 13/20*** | (2006.01) |
| ***H01T 13/22*** | (2006.01) |
| ***H01T 19/00*** | (2006.01) |

(52) U.S. Cl.
USPC ..... 313/141; 445/7

(58) Field of Classification Search
USPC ..... 313/141, 143, 118; 445/7
See application file for complete search history.

(56) References Cited

U.S. PATENT DOCUMENTS

| | | | |
|---|---|---|---|
| 2,205,196 | A | 6/1940 | Harper, Jr. |
| 2,265,532 | A | 12/1941 | Levine |
| 2,603,022 | A | 7/1952 | Craig |
| 2,733,369 | A | 1/1956 | Smits |
| 2,840,742 | A | 6/1958 | Walters |
| 3,037,140 | A | 5/1962 | Schurecht |
| 3,046,434 | A | 7/1962 | Schurecht |
| 3,133,223 | A | 5/1964 | Mallory |
| 3,442,693 | A | 5/1969 | Rea |

(Continued)

FOREIGN PATENT DOCUMENTS

| | | |
|---|---|---|
| DE | 19747700 | 10/1997 |
| DE | 102004058925 | 12/2004 |

(Continued)

OTHER PUBLICATIONS

International Search Report PCT/US2011/057438 mailed on Jun. 28, 2012.

*Primary Examiner* — Karabi Guharay
(74) *Attorney, Agent, or Firm* — Robert L. Stearns; Dickinson Wright, PLLC

(57) ABSTRACT

An igniter (20) of a corona ignition system emits a non-thermal plasma in the form of a corona (30) to ionize and ignite a fuel mixture. The igniter (20) includes an electrode (32) and a ceramic insulator (22) surrounding the electrode (32). The insulator (22) surrounds a firing end (38) of the electrode (32) and blocks the electrode (32) from exposure to the combustion chamber (28). The insulator (22) presents a firing surface (56) exposed to the combustion chamber (28) and emitting the non-thermal plasma. A plurality of electrically conducting elements (24) are disposed in a matrix (26) of the ceramic material and along the firing surface (56) of the insulator (22), such as metal particles embedded in the ceramic material or holes in the ceramic material. The electrically conducting elements (24) reduce arc discharge during operation of the igniter (20) and thus improve the quality of ignition.

23 Claims, 3 Drawing Sheets

(56) References Cited

U.S. PATENT DOCUMENTS

| | | | | |
|---|---|---|---|---|
| 3,911,307 | A | 10/1975 | Goto et al. | |
| 4,261,085 | A | 4/1981 | Nishio et al. | |
| 4,284,054 | A | 8/1981 | Kumagai et al. | |
| 4,337,408 | A | 6/1982 | Sone et al. | |
| 4,354,136 | A | 10/1982 | Hamai et al. | |
| 4,388,549 | A | 6/1983 | Bensman | |
| 4,396,855 | A | 8/1983 | Imai et al. | |
| 4,539,503 | A | 9/1985 | Esper et al. | |
| 4,659,960 | A | 4/1987 | Toya et al. | |
| 4,692,657 | A | 9/1987 | Grunwald et al. | |
| 4,914,344 | A * | 4/1990 | Watanabe et al. | 313/141 |
| 5,469,013 | A | 11/1995 | Kang | |
| 7,305,954 | B2 | 12/2007 | Hagiwara et al. | |
| 7,328,677 | B2 | 2/2008 | Hagiwara et al. | |
| 7,477,008 | B2 | 1/2009 | Artmann et al. | |
| 7,843,117 | B2 * | 11/2010 | Jaffrezic et al. | 313/145 |
| 2007/0114898 | A1 | 5/2007 | Nagasawa et al. | |
| 2007/0114901 | A1 | 5/2007 | Nagasawa et al. | |
| 2008/0141967 | A1 | 6/2008 | Tani et al. | |
| 2008/0238281 | A1 | 10/2008 | Nakamura et al. | |
| 2009/0021133 | A1 | 1/2009 | Kato et al. | |
| 2009/0031988 | A1 | 2/2009 | Shiraishi et al. | |
| 2010/0212620 | A1 | 8/2010 | Shimizu | |

FOREIGN PATENT DOCUMENTS

| | | | |
|---|---|---|---|
| DE | 102006037037 | | 8/2006 |
| EP | 475288 | | 9/1991 |
| EP | 913897 | | 9/1998 |
| FR | 2859831 | | 9/2003 |
| FR | 2859831 | A1 | 9/2012 |
| WO | WO 2008017601 | | 2/2008 |

* cited by examiner

NON-THERMAL PLASMA IGNITION ARC SUPPRESSION

CROSS REFERENCE TO RELATED APPLICATION

This application claims the benefit of U.S. provisional application Ser. No. 61/407,633, filed Oct. 28, 2010, and U.S. provisional application Ser. No. 61/407,643, filed Oct. 28, 2010, which are incorporated herein by reference in their entirety.

BACKGROUND OF THE INVENTION

1. Field of the Invention

This invention relates generally to a corona discharge igniter for emitting a non-thermal plasma to ignite a mixture of fuel and air of a combustion chamber, and methods of manufacturing the same.

2. Description of the Prior Art

An example of a corona discharge ignition system is disclosed in U.S. Pat. No. 6,883,507 to Freen. In the corona discharge ignition system, an electrode of an igniter is charged to a high radio frequency ("RF") voltage potential, creating a strong RF electric field in the combustion chamber. The electric field causes a portion of the fuel-air mixture in the combustion chamber to ionize and begin dielectric breakdown, facilitating combustion of the fuel-air mixture. However, the electric field is controlled so that the fuel-air mixture maintains dielectric properties and corona discharge occurs, also referred to as a non-thermal plasma. The electric field is controlled so that the fuel-air mixture does not lose of all dielectric properties, which would create a thermal plasma and an electric arc between the electrode and grounded cylinder walls or piston. The current of the corona discharge is small and the voltage potential at the electrode remains high in comparison to an arc discharge. The ionized portion of the fuel-air mixture forms a flame front which then becomes self-sustaining and combusts the remaining portion of the fuel-air mixture.

The electrode of the corona discharge ignition system is typically formed of an electrically conductive material extending from an electrode terminal end to an electrode firing end, and an insulator including a matrix of electrically insulating material extends along the electrode. The igniter of the corona discharge ignition system does not include any grounded electrode element in close proximity to the electrode. Rather, as alluded to above, the ground is provided by the cylinder walls or piston of the internal combustion engine. An example igniter is disclosed in U.S. Patent Application Publication No. US 2010/0083942 to Lykowski and Hampton.

For internal combustion engine applications, it is typically preferred that the non-thermal plasma formed includes multiple streams of ions in the form of a corona discharge. The streams ignite the air-fuel mixture along the entire length of the streams, throughout the combustion chamber, and thus provide a robust ignition. As discussed in the Freen patent, the electric field is preferably controlled so that the corona discharge does not proceed to an electron avalanche which would result in an arc discharge from the electrode to the pounded cylinder wall or piston. Under certain conditions, such as when voltages above a certain threshold are applied to the igniter, the density of the ions increases and the arc discharge may be formed. The arc discharge comprises a single stream of ions, rather than the desired plurality of streams.

The arc discharge occupies a much smaller space in the combustion chamber than the corona discharge and thus can reduce the quality of ignition.

SUMMARY OF THE INVENTION

One aspect of the invention provides an igniter of a corona ignition system including an electrode and an insulator extending along the electrode. The electrode is formed of an electrically conductive material and extends from an electrode terminal end to an electrode firing end. The insulator includes a matrix of an electrically insulating material around the electrode firing end, and a plurality of electrically conducting elements disposed in the matrix of electrically insulating material.

Another aspect of the invention provides a method of forming the igniter. The method comprises the steps of providing the insulator formed of a matrix of electrically insulating material with a plurality of electrically conducting elements disposed therein, and providing the electrode formed of the electrically conductive material extending from an electrode terminal end to an electrode firing end. The method further includes disposing the insulator around the electrode firing end.

The igniter of the present invention, including the insulator with electrically conducting elements, reduces or eliminates arcing during operation of the corona ignition system, compared to other igniters without the electrically conducting elements. The igniter creates a controlled and repeatable non-thermal plasma including multiple streams of ions in the form of a corona. The corona discharge emitted from the igniter provides rapid ignition and burning of the fuel mixture, which leads to numerous benefits when used in an internal combustion engine applications, such as improved fuel economy and reduced $CO_2$ emissions.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
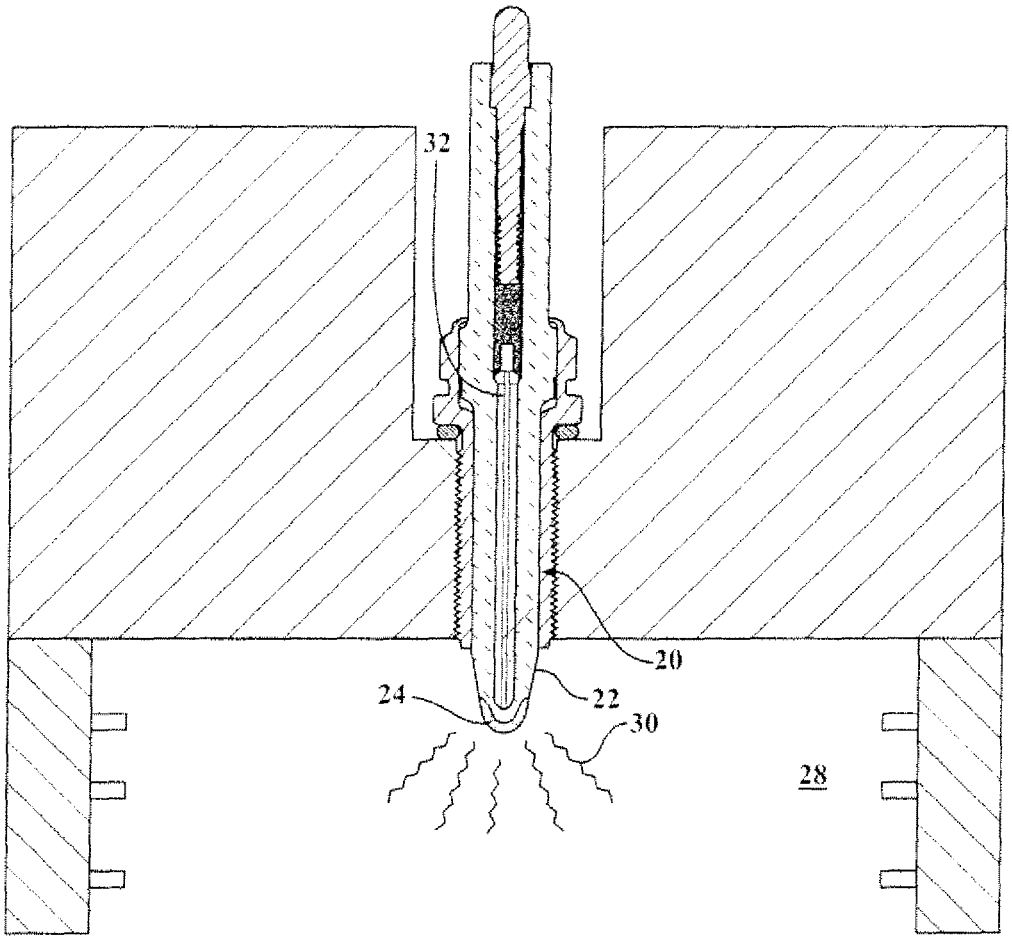
FIG. 1 is a cross-sectional view of an igniter in accordance with one aspect of the invention disposed in a combustion chamber of an internal combustion engine.
Figure 2:
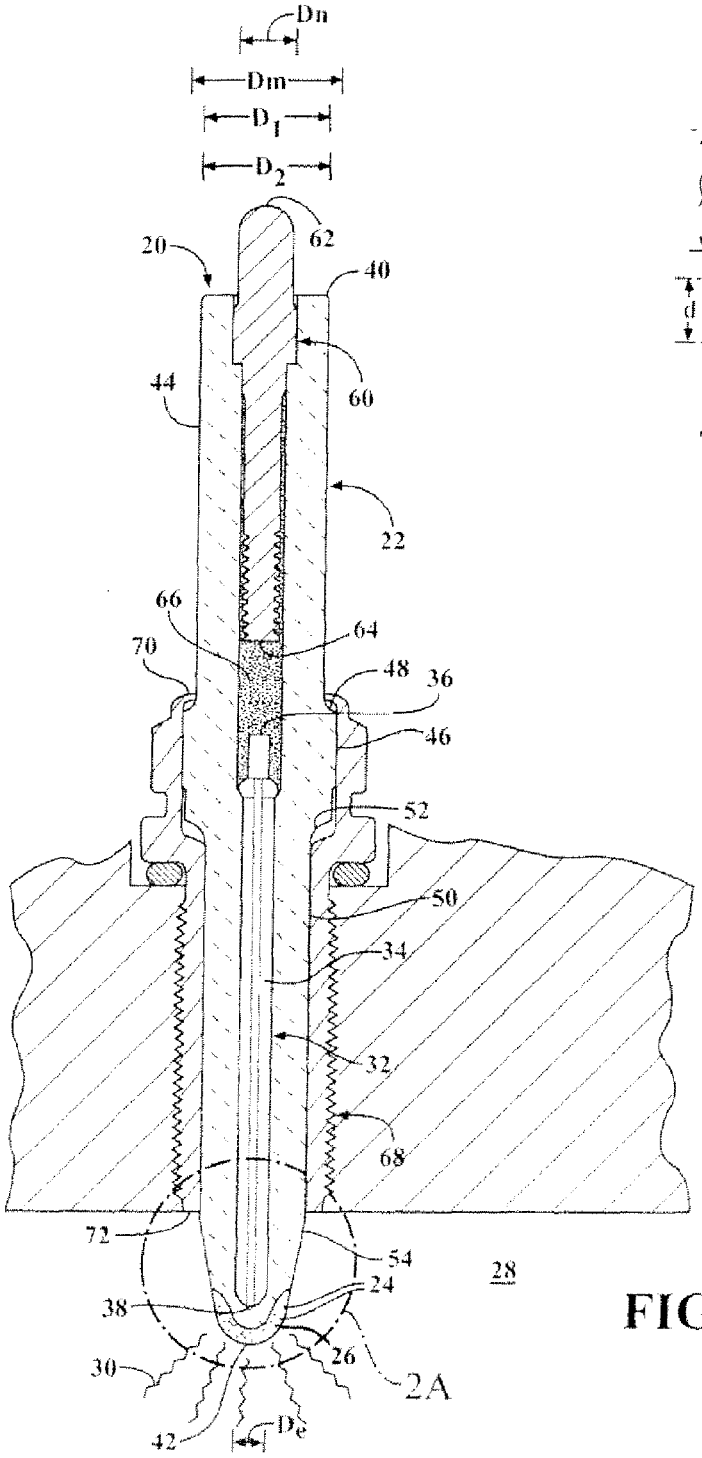
FIG. 2 is a cross-sectional view of an igniter in accordance with another aspect of the invention.
Figure 3:
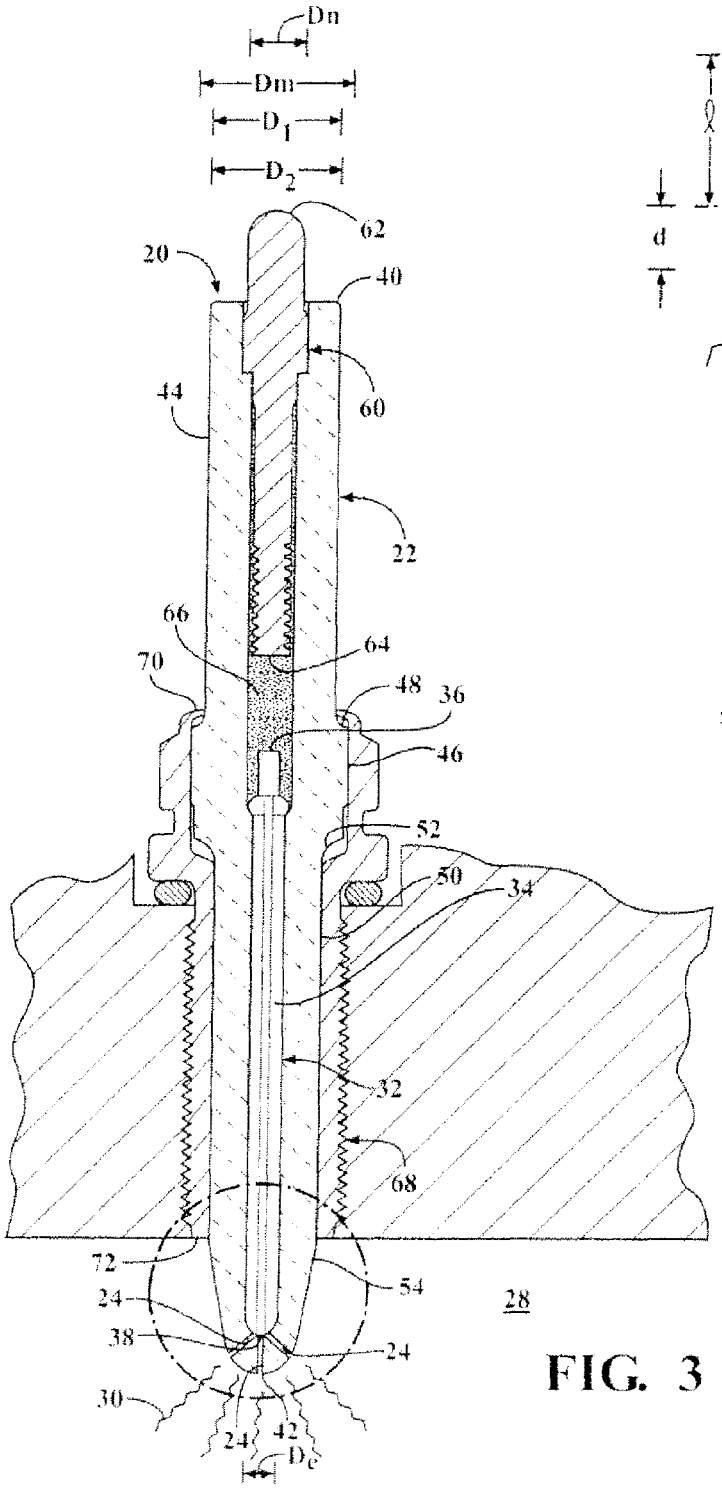
FIG. 3 is a cross-sectional view of an igniter in accordance with another aspect of the invention.

One aspect of the invention provides an igniter 20 for a corona ignition system, as shown in FIGS. 1-3. The igniter 20 includes an insulator 22 with a plurality of electrically conducting elements 24 disposed in a matrix 26 of electrically insulating material, such as metal particles embedded in the matrix 26, or holes in the matrix 26. As shown in FIG. 1, the igniter 20 is disposed in a combustion chamber 28 of an internal combustion engine and receives a voltage from a power source (not shown). An electrode 32 of the igniter 20 is charged to a high RF voltage potential, creating a strong RF electric field in the combustion chamber. The electric field is controlled so the mixture of fuel and air in the combustion chamber maintains dielectric properties. The electrode 32 emits a non-thermal plasma including multiple streams of ions forming a corona 30 to ionize a portion of the fuel and air in the combustion chamber 28.

The electrode 32 of the igniter 20 includes an electrode body portion 34 extending longitudinally from an electrode terminal end 36 to an electrode firing end 38. The electrode 32 has an electrode diameter $D_e$ extending across the electrode 32 and perpendicular to the longitudinal electrode body portion 34, as shown in FIGS. 2 and 3. The electrode 32 is formed of an electrically conductive material, such as nickel, copper, or alloys thereof. In one embodiment, shown in FIGS. 2 and 2A, the electrode 32 includes a copper core surrounded by a nickel clad.

The insulator 22 of the igniter 20 is disposed annularly around and longitudinally along the electrode body portion 34. The insulator 22 extends from an insulator upper end 40 to an insulator firing end 42 adjacent the electrode firing end 38. As best shown in FIGS. 2 and 3, the insulator 22 extends past the electrode firing end 38 to the insulator firing end 42. The insulator 22 comprises a matrix 26 of an electrically insulating material, such as sintered alumina or another ceramic or glass material. The electrically insulating material preferably has a permittivity capable of holding an electrical charge. The electrically insulating material has an electrical conductivity significantly less than the electrical conductivity of the electrode 32.

As shown in FIGS. 2 and 3, in one embodiment, the insulator 22 includes an insulator first region 44 extending from the insulator upper end 40 toward the insulator firing end 42. The insulator first region 44 presents an insulator first diameter $D_1$ extending generally perpendicular to the longitudinal electrode body portion 34. The insulator 22 also includes an insulator middle region 46 adjacent the insulator first region 44 and extending toward the insulator firing end 42. The insulator middle region 46 presents an insulator middle diameter $D_m$ extending generally perpendicular to the longitudinal electrode body portion 34. The insulator middle diameter $D_m$ of this embodiment is greater than the insulator first diameter $D_1$. An insulator upper shoulder 48 extends radially outwardly from the insulator first region 44 to the insulator middle region 46. The insulator 22 further includes an insulator second region 50 adjacent the insulator middle region 46 and extending toward the insulator firing end 42. The insulator second region 50 presents an insulator second diameter $D_2$ extending generally perpendicular to the longitudinal electrode body portion 34. The insulator second diameter $D_2$ is typically equal to the insulator first diameter $D_1$. An insulator lower shoulder 52 extends radially inwardly from the insulator middle region 46 to the insulator second region 50.

The insulator 22 of the igniter 20 further includes an insulator nose region 54 extending from the insulator second region 50 to the insulator firing end 42. The insulator nose region 54 is typically disposed in the combustion chamber 28. During operation of the corona ignition system, the insulator nose region 54 is exposed to the mixture of fuel and air in the combustion chamber 28, while the insulator first region 44, the insulator middle region 46, and the insulator second region 50 remain in the engine block unexposed to the combustion chamber 28, as shown in FIGS. 2 and 3. The insulator nose region 54 presents an insulator nose diameter $D_n$ generally perpendicular to the longitudinal electrode body portion 34. The insulator nose diameter $D_n$ typically tapers from the insulator second region 50 to the insulator firing end 42 so that the insulator nose diameter $D_n$ is less than the insulator second diameter $D_2$.

The insulator nose region 54 presents a firing surface 56 extending across and surrounding the insulator firing end 42. During use of the igniter 20 in the corona ignition system, the firing surface 56 is exposed to the combustion chamber 28 and emits the non-thermal plasma forming the corona 30. In one embodiment, the firing surface 56 presents a round and convex profile, free of sharp edges. The round nature of the firing surface 56 can be described as a spherical radius facing downwardly into the combustion chamber 28.

Figure 2A:
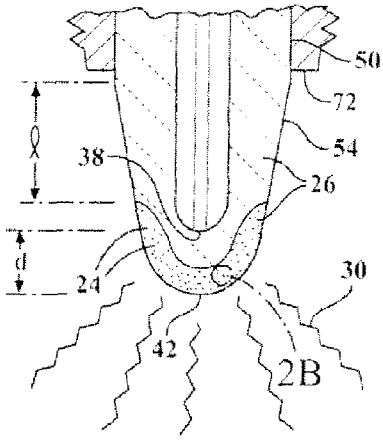
FIG. 2A is an enlarged view of an insulator nose region of the igniter of FIG. 2.
Figure 3A:
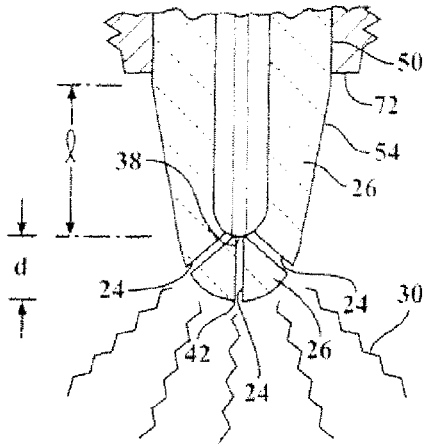
FIG. 3A is an enlarged view of an insulator nose region of the igniter of FIG. 3.

The insulating material of the insulator 22, including at the insulating material of the insulator nose region 54 and the other regions 44, 46, and 50, spaces the electrode 32 from the combustion chamber 28. As best shown in FIGS. 2A and 3A, the electrode firing end 38 is disposed in the insulator nose region 54 and is spaced from the insulator firing end 42 by the matrix 26 of insulating material. In one embodiment, the electrode firing end 38 is spaced from the insulator firing end 42 by a distance d of about 0.06 to 0.07 cm.

As stated above, the plurality of electrically conducting elements 24 are disposed in a portion of the matrix 26 of electrically insulating material and are spaced from one another by the matrix 26 of insulating material. The electrically conducting elements 24 are preferably disposed adjacent the firing surface 56 and along the firing surface 56 of the insulator nose region 54 so that at least a portion of the electrically conducting elements 24 are directly exposed to the combustion chamber 28. As shown in FIGS. 2A and 3A, the electrically conducting elements 24 are preferably disposed between the electrode firing end 38 and the insulator firing end 42.

During use of the igniter 20 in the corona ignition system, the electrode 32 receives the energy from the power source and emits an electrical field around the electrode firing end 38. The electrically conducting elements 24 receive the electrical field being emitted from the electrode 32 and then emit an electrical field in the surrounding area. The electrical field in the area surrounding the electrically conducting elements 24 induces the non-thermal plasma emissions from the firing surface 56 of the insulator nose region 54 forming the corona 30 shown in FIGS. 1-3.

The insulator first region 44, insulator middle region 46, and insulator second region 50 are typically free of the electrically conducting elements 24. Further, a portion of the insulator nose region 54 is also typically free of the electrically conducting elements 24. In one embodiment, as shown in FIGS. 2A and 3A, the insulator nose region 54 is free of the electrically conducting elements 24 in a portion extending from the insulator second region 50 a predetermined length l toward the insulator firing end 42. The portion of the insulator nose region 54 free of the electrically conducting elements 24 is typically spaced from the insulator firing surface 56. In an alternate embodiment (not shown), the insulator 22 includes the electrically conducting elements 24 throughout the insulator nose region 54 or in other regions or portions of the insulator 22.

In one embodiment, the portion of the insulator 22 including the electrically conducting elements 24, such as a portion of the insulator nose region 54, is homogenous with the portions of the insulator 22 free of the electrically conducting elements 24. For example, the insulator nose region 54 including the electrically conducting elements 24 is homogenous with the remainder of the insulator nose region 54, such as the portion extending along the predetermined length l discussed above. In this embodiment, the insulator nose region 54 is also homogeneous with the insulator second region 50, insulator middle region 46, and insulator first region 44. In another embodiment, such as the embodiment of FIG. 2, the portion of the insulator 22 including the electrically conducting elements 24, such as a portion of the insulator nose region 54, is formed separate from the other portions of the insulator 22, which are free of the electrically conducting elements 24, and then subsequently the portions and regions are attached together.

Figure 2B:
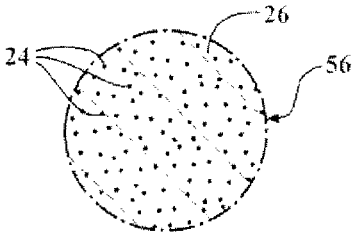
FIG. 2B is an enlarged view of a firing surface of the insulator nose region of FIG. 2A.

The insulator 22 can include various types of electrically conducting elements 24. In one preferred embodiment, the electrically conducting elements 24 include the particles embedded in the matrix 26 of insulating material, as shown in FIGS. 1-2B. The particles typically comprise metal, and preferably include at least one element selected from Groups 3 through 12 of the Period Table of the Elements, such as iridium. The particles have a particle size of 0.5 to 250 microns. The particles are dispersed throughout a portion of the insulator nose region 54 along and adjacent the firing surface 56, so that some of the particles are directly exposed to the combustion chamber 28. FIG. 2B shows an enlarged view of the exposed particles along the firing surface 56 of the insulator 22. The particles are spaced from one another by the matrix 26 of insulating material. In this embodiment, the insulator nose region 54 extends continuously between the insulator second region 50 and the insulator firing end 42 and encases the electrode firing end 38 of the electrode 32. The firing surface 56 of the insulator nose region 54 is closed and blocks the electrode 32 from fluid communication with the combustion chamber 28. Thus, the electrode 32 is completely separated from the combustion chamber 28 by the matrix 26 of insulating material.

In the embodiment of FIG. 2-2B, the particles receive the electrical field emitted from the electrode 32 and then emit an electrical field in the surrounding area, which induces the non-thermal plasma emissions from the insulator nose region 54 and forms the corona 30. The insulator 22 of this embodiment provides a high impedance between the metal particles and the electrode firing end 38. Thus, the insulator 22 reduces or eliminates the chance of arcing when a high density plasma is created, compared to other insulators 22 used in corona ignition systems without the electrically conducting elements 24.

Figure 3B:
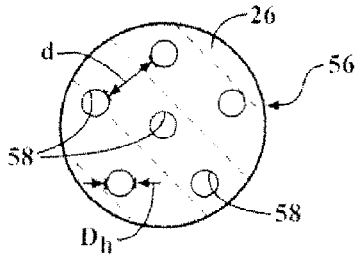
FIG. 3B is an enlarged view of a firing surface of the insulator nose region of FIG. 3A.

In another embodiment, the electrically conducting elements 24 comprise the holes in the matrix 26 of insulating material connecting the electrode 32 to the combustion chamber 28, as shown in FIGS. 3-3B. Each hole extends continuously from the electrode 32 to the firing surface 56 of the insulator 22, and the holes are spaced from one another by the matrix 26 of insulating material. Each hole also has an inner surface 58 and is open at the firing surface 56. Thus, the inner surfaces 58 of the holes are in fluid communication with and directly exposed to the combustion chamber 28. FIG. 3B shows an enlarged view of the openings of the holes at the firing surface 56. The inner surfaces 58 provided by the holes are also exposed to the electrical field emitted from the electrode 32, as are the particles. Thus, the holes of the insulator nose region 54 facilitate formation of high gradient electric fields inside the combustion chamber 28. The inner surfaces 58 of the holes emit an electrical field in the surrounding area, which induces the non-thermal plasma emissions from the insulator nose region 54 and forms the corona 30. The insulator 22 of this embodiment also reduces or eliminates the chance of arcing when a high density plasma is created, compared to other insulators 22 used in corona 30 ignition systems without the electrically conducting elements 24.

In one embodiment, the inner surface 58 of each hole presents a cylindrical shape having a hole diameter $D_h$ less than the electrode diameter $D_e$. In one embodiment, each of the holes have a hole diameter $D_h$ of 0.016 cm. The insulator nose region 54 can include six of the holes equally spaced from one another by a predetermined distance d, as shown in FIG. 3B. One of the holes extends transversely from the electrode firing end 38 to the insulator firing end 42 and five of the holes surround the center hole and each extend from the electrode 32 to the firing surface 56. Further, in an alternate embodiment, not shown, the insulator 22 includes both the metal particles and the holes, or other types of electrically conducting elements 24 instead of or in addition to the particles and holes.

The corona igniter 20 also typically includes other elements known in the art. For example, as shown in FIGS. 2 and 3, a terminal 60 formed of an electrically conductive material extends from a first terminal end 62 to a second terminal end 64 and is received in the insulator 22. The first terminal end 62 is electrically connected to the power source of the corona ignition system and the second terminal end 64 is electrically connected to the electrode terminal end 36. A resistor layer 66 formed of an electrically conductive material is disposed between and electrically connects the second terminal end 64 and the electrode terminal end 36. The terminal 60 is electrically connected to a wire, which is electrically connected to the power source of the corona ignition system. During operation of the corona ignition system, the terminal 60 receives energy from the power source and transmits the energy through the resistor layer 66 to the electrode 32. The igniter 20 also typically includes a shell 68 formed of a metal material disposed annularly around the insulator 22. The shell 68 extends longitudinally along the insulator 22 from an upper shell end 70 to a lower shell end 72 such that the insulator nose region 54 projects outwardly of the lower shell end 72, as shown in FIGS. 2 and 3.

Another aspect of the invention provides a method of forming the igniter 20 for emitting a non-thermal plasma in a corona ignition system. The method includes providing the electrode 32 and the insulator 22 formed of the electrically insulating material with the electrically conducting elements 24 disposed therein, as described above.

The step of providing the insulator 22 can include various process steps. In one embodiment, the method includes forming the insulator 22 with the electrically conducting elements 24 in a single process step, such as molding the matrix 26 to include the electrically conducting elements 24. Alternatively, the method can include preparing the insulator 22 in several process steps. For example, the insulator first region 44, insulator middle region 46, insulator second region 50, and portion of the insulator nose region 54 can be formed first, each free of the electrically conducting elements 24, followed by attachment of the portion of the insulator nose region 54 with the electrically conducting elements 24 to the other regions.

In one embodiment, when the electrically conducting elements 24 comprise the metal particles, the step of providing the insulator 22 first includes providing a sintered preform of the electrically insulating material. Next, the method includes mixing the particles with a paste of the electrically insulating material, followed by applying the mixture to the sintered preform. The mixture and sintered preform are then heated, preferably sintered, to fuse the mixture and the preform together. Alternatively, the paste mixture can be sintered separate from the preform and then the two sintered parts can be mechanically or otherwise attached together. In another embodiment, the step of providing the insulator 22 first includes providing the sintered preform, and then mechanically embedding the particles of electrically conductive material in the sintered preform. In yet another embodiment, non-sintered electrically insulating material is mixed with the particles, and the mixture is subsequently sintered to provide the insulator 22.

In another embodiment, when the electrically conducting elements 24 comprise holes in the matrix 26 of insulating material, the step of providing the insulator 22 can first include providing a sintered preform of the electrically insulating material, followed by drilling the holes in the sintered preform. Alternatively, the holes can be formed in the sintered preform by a laser or other methods. In another embodiment, the holes are molded into the electrically insulating material of the insulator 22 in a molding apparatus, followed by sintering the molded material. In yet another embodiment, the portion of the insulator 22 with the holes is formed separate from the other portions and regions of the insulator 22, and then mechanically or otherwise attached together.

As stated above, during operation of the corona ignition system, the electrode 32 of the igniter 20 receives the energy from the power source and emits an electrical field. This electrical field from the electrode 32 induces an electrical field around each of the electrically conducting elements 24, which induces the non-thermal plasma in the combustion chamber 28. The non-thermal plasma forms a corona 30 and ignites the mixture of fuel and air in the combustion chamber 28. By using the igniter 20 of the present invention, with the electrically conducting elements 24, the non-thermal plasma is less likely to arc, even when a high density plasma is created, compared to igniters 20 of corona ignition systems without the electrically conducting elements 24.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility. In addition, the reference numerals in the claims are merely for convenience and are not to be read in any way as limiting.

ELEMENT LIST

| Element Symbol | Element Name |
|---|---|
| d | distance |
| l | length |
| 20 | igniter |
| 22 | insulator |
| 24 | electrically conducting elements |
| 26 | matrix |
| 28 | combustion chamber |
| 30 | corona |
| 32 | electrode |
| 34 | electrode body portion |
| 36 | electrode terminal end |
| 38 | electrode firing end |
| 40 | insulator upper end |
| 42 | insulator firing end |
| 44 | insulator first region |
| 46 | insulator middle region |
| 48 | insulator upper shoulder |
| 50 | insulator second region |
| 52 | insulator lower shoulder |
| 54 | insulator nose region |
| 56 | firing surface |
| 58 | inner surface |
| 60 | terminal |
| 62 | first terminal end |
| 64 | second terminal end |

-continued

ELEMENT LIST

| Element Symbol | Element Name |
|---|---|
| 66 | resistor layer |
| 68 | shell |
| 70 | upper shell end |
| 72 | lower shell end |
| $D_1$ | insulator first diameter |
| $D_2$ | insulator second diameter |
| $D_e$ | electrode diameter |
| $D_h$ | hole diameter |
| $D_m$ | insulator middle diameter |
| $D_n$ | insulator nose diameter |

What is claimed is:

1. An igniter for emitting a non-thermal plasma in a combustion chamber comprising:

an electrode formed of an electrically conductive material and extending from an electrode terminal end to an electrode firing end for receiving energy from a power source and emitting an electrical field around said electrode firing end;

an insulator extending along said electrode;

said insulator including a matrix of an electrically insulating material around said electrode firing end; and a plurality of electrically conducting elements disposed in said matrix of electrically insulating material the electrically conducting elements receiving the electrical field from said electrode and emitting an electrical field in an area surrounding said electrically conducting elements, wherein the electrical field in the area surrounding said electrically conducting elements induces emission of the non-thermal plasma from said insulator and forms a corona.

2. The igniter of claim 1 wherein said insulator extends past said electrode to an insulator firing end such that said electrode firing end is spaced from said insulator firing end by said matrix of electrically insulating material.

3. The igniter of claim 1 wherein said insulator presents a firing surface at said electrode firing end and said electrically conducting elements are disposed along said firing surface for being exposed to the combustion chamber.

4. The igniter of claim 3 wherein said electrically conducting elements are disposed between said electrode firing end and said firing surface.

5. The igniter of claim 3 wherein said firing surface of said insulator is convex.

6. The igniter of claim 1 wherein said matrix of electrically insulating material encases said electrode firing end.

7. The igniter of claim 1 wherein said electrically conducting elements are spaced from one another by said matrix of insulating material.

8. The igniter of claim 1 wherein a portion of said insulator spaced from said firing surface and extending along a predetermined length is free of said electrically conducting elements.

9. The igniter of claim 1 wherein said electrically conducting elements include particles of an electrically conductive material embedded in said matrix of insulating material.

10. The igniter of claim 9 wherein said particles comprise at least one element selected from Groups 3 through 12 of the Period Table.

11. The igniter of claim 9 wherein said particles have a particle size of 0.5 to 250 microns.

12. The igniter of claim 1 wherein said electrically conducting elements are holes in said matrix of insulating material extending continuously from said electrode to said firing surface.

13. The igniter of claim 12 wherein each of said holes presents an inner surface open at said firing surface for being in fluid communication with the combustion chamber.

14. The igniter of claim 12 wherein said electrode has an electrode diameter and each of said holes has a hole diameter being less than said electrode diameter.

15. The igniter of claim 12 wherein each of said holes are equally spaced from one another by a predetermined distance.

16. An igniter for receiving a voltage from a power source and emitting a non-thermal plasma that forms a corona to ionize a mixture of fuel and air in a combustion chamber of an internal combustion engine comprising:

an electrode including an electrode body portion extending longitudinally from an electrode terminal end to an electrode firing end for receiving the energy from the power source and emitting an electrical field around said electrode firing end;

said electrode having an electrode diameter extending across said electrode and perpendicular to said longitudinal electrode body portion;

said electrode formed of an electrically conductive material;

said electrically conductive material including nickel;

an insulator disposed annularly around and longitudinally along said electrode body portion and extending from an insulator upper end to an insulator firing end adjacent said electrode firing end;

said insulator extending past said electrode firing end to said insulator firing end;

said insulator including a matrix formed of an electrically insulating material;

said electrically insulating material including alumina;

said electrically insulating material having a permittivity capable of holding an electrical charge;

said electrically insulating material having an electrical conductivity less than the electrical conductivity of said electrically conductive material of said electrode;

said insulator including an insulator first region extending from said insulator upper end toward said insulator firing end;

said insulator first region presenting an insulator first diameter extending generally perpendicular to said longitudinal electrode body portion;

said insulator including an insulator middle region adjacent said insulator first region and extending toward said insulator firing end;

said insulator middle region presenting an insulator middle diameter extending generally perpendicular to said longitudinal electrode body portion and being greater than said insulator first diameter;

said insulator presenting an insulator upper shoulder extending radially outwardly from said insulator first region to said insulator middle region;

said insulator including an insulator second region adjacent said insulator middle region and extending toward said insulator firing end;

said insulator second region presenting an insulator second diameter extending generally perpendicular to said longitudinal electrode body portion;

said insulator second diameter being equal to said insulator first diameter;

said insulator presenting an insulator lower shoulder extending radially inwardly from said insulator middle region to said insulator second region;

said insulator including an insulator nose region extending from said insulator second region to said insulator firing end for being disposed in and exposed to the combustion chamber while said insulator first region and said insulator middle region and said insulator second region are not exposed to the combustion chamber;

said insulator nose region presenting an insulator nose diameter generally perpendicular to said longitudinal electrode body portion and tapering to said insulator firing end;

said insulator nose diameter being less than said insulator second diameter;

said insulator nose region presenting a firing surface extending across and surrounding said insulator firing end for being exposed to said combustion chamber;

said firing surface presenting a round and convex profile with a spherical radius for facing downwardly into the combustion chamber;

said insulating material of said insulator nose region for spacing said electrode from the combustion chamber;

said electrode firing end being disposed in said insulator nose region and spaced from said insulator firing end by said matrix of insulating material;

said electrode firing end being spaced from said insulator firing end by a distance of 0.065 cm;

a plurality of electrically conducting elements disposed throughout a portion of said matrix of insulating material adjacent said firing surface and along said firing surface of said insulator nose region the electrically conductive elements receiving the electrical field from said electrode and emitting an electrical field in an area surrounding said electrically conducting elements, wherein the electrical field in the area surrounding said electrically conducting elements induces emission of a non-thermal plasma from said insulator nose region forming the corona;

said electrically conducting elements being disposed in said matrix of insulating material between said electrode firing end and said insulator firing end;

said electrically conducting elements disposed along said firing surface for being exposed to said combustion chamber;

said insulator first region and said insulator middle region and said insulator second region being free of said electrically conducting elements;

a portion of said insulator nose region being free of said electrically conducting elements;

said insulator nose region being free of said electrically conducting elements in an area extending from said insulator second region a predetermined length toward said firing end;

said electrically conducting elements being spaced from one another by said matrix of insulating material;

a terminal received in said insulator for being electrically connected to a terminal wire electrically connected to the power source and being in electrical communication with said electrode for receiving energy from the power source and transmitting the energy to said electrode;

said terminal extending from a first terminal end to a second terminal end electrically connected to said electrode terminal end;

said terminal formed of an electrically conductive material;

a resistor layer disposed between and electrically connecting said second terminal end and said electrode terminal end for providing the energy from said terminal to said electrode;

said resistor layer formed of an electrically conductive material;

a shell disposed annularly around said insulator;

said shell formed of a metal material; and said shell extending longitudinally along said insulator from an upper shell end to a lower shell end such that said insulator nose region projects outwardly of said lower shell end.

17. The igniter of claim 16 wherein a portion of said insulator nose region is separate from other portions of said insulator nose region and attached to said other portions.

18. The igniter of claim 16 further comprising said insulator nose region extending continuously between said insulator second region and said insulator firing end;

said insulator nose region encasing said electrode firing end of said electrode;

said firing surface of said insulator nose region being closed for blocking said electrode from fluid communication with the combustion chamber such that said electrode is completely separated from the combustion chamber by said matrix of insulating material;

said electrically conducting elements being particles embedded in said matrix of insulating material and dispersed throughout a portion of said insulator nose region along and adjacent said firing surface;

said particles spaced from one another by said matrix of insulating material;

said particles comprising at least one element selected from Groups 3 through 12 of the period table of the elements;

said particles comprising iridium; and said particles having a particle size of 0.5 to 250 microns.

19. The igniter of claim 16 further comprising said electrically conducting elements being holes in said matrix of insulating material of said insulator nose region;

each of said holes spaced from one another by said matrix of insulating material;

each of said holes extending continuously from said electrode to said firing surface of said insulator;

each of said holes having an inner surface presenting a cylindrical shape open at said firing surface for being in fluid communication with the combustion chamber;

said inner surface of each of said holes presenting a hole diameter being less than said electrode diameter;

said insulator nose region including six of said holes spaced from one another by a predetermined distance;

one of said holes extending transversely from said electrode firing end to said insulator firing end and five of said holes surrounding said center hole and each extending from said electrode to said firing surface and spaced equally from one another by said predetermined distance; and each of said holes having a hole diameter of 0.016 cm.

20. A method of forming an igniter for emitting a non-thermal plasma comprising the steps of:

providing an electrode formed of an electrically conductive material extending from an electrode terminal end to an electrode firing end for receiving energy from a power source and emitting an electrical field around the electrode firing end;

providing an insulator formed of a matrix of electrically insulating material with a plurality of electrically conducting elements disposed therein, the electrically conducting elements receiving the electrical field from the electrode and emitting an electrical field in an area surrounding the electrically conducting elements, wherein the electrical field in the area surrounding the electrically conducting elements induces emission of the non-thermal plasma from the insulator nose region and forms a corona; and disposing the insulator around the electrode firing end.

21. The method of claim 20 wherein the step of providing the insulator includes providing a sintered preform of the electrically insulating material; mixing particles of an electrically conductive material with a paste of the electrically insulating material; applying the mixture to the sintered preform; and heating the mixture and the sintered preform.

22. The method of claim 20 wherein the step of providing the insulator includes providing a sintered preform of the electrically insulating material; and embedding particles of electrically conductive material in the sintered preform.

23. The method of claim 20 wherein the step of providing the insulator includes mixing the electrically insulating material with particles of electrically conductive material; and sintering the mixture.

* * * * *

UNITED STATES PATENT AND TRADEMARK OFFICE

CERTIFICATE OF CORRECTION

PATENT NO. : 8,729,782 B2
APPLICATION NO. : 13/283666
DATED : May 20, 2014
INVENTOR(S) : Lykowski et al.

It is certified that error appears in the above-identified patent and that said Letters Patent is hereby corrected as shown below:

In the Specification

| column | line | |
|---|---|---|
| 1 | 63 | "pounded" should read "grounded" |

Signed and Sealed this
Twelfth Day of August, 2014

Michelle K. Lee

Michelle K. Lee
*Deputy Director of the United States Patent and Trademark Office*